US011927434B2

(12) United States Patent
Hwang

(10) Patent No.: US 11,927,434 B2
(45) Date of Patent: Mar. 12, 2024

(54) DEVICE AND METHOD FOR MANAGING REGISTRATION AND ARRANGEMENT OF DETONATOR

(71) Applicant: HANWHA CORPORATION, Seoul (KR)

(72) Inventor: Ki Won Hwang, Cheongju-si (KR)

(73) Assignee: HANWHA CORPORATION, Seoul (KR)

( * ) Notice: Subject to any disclaimer, the term of this patent is extended or adjusted under 35 U.S.C. 154(b) by 468 days.

(21) Appl. No.: 17/252,460

(22) PCT Filed: Dec. 4, 2020

(86) PCT No.: PCT/KR2020/017598
§ 371 (c)(1),
(2) Date: Dec. 15, 2020

(87) PCT Pub. No.: WO2021/118169
PCT Pub. Date: Jun. 17, 2021

(65) Prior Publication Data

US 2021/0364265 A1 Nov. 25, 2021

(30) Foreign Application Priority Data

Dec. 10, 2019 (KR) ..... 10-2019-0164047

(51) Int. Cl.
*F42D 1/055* (2006.01)
*F42B 3/12* (2006.01)

(52) U.S. Cl.
CPC ..... *F42D 1/055* (2013.01); *F42B 3/122* (2013.01)

(58) Field of Classification Search
None
See application file for complete search history.

(56) References Cited

U.S. PATENT DOCUMENTS 6,644,202 B1 11/2003 Duniam et al.
8,854,621 B1 10/2014 Muschol

FOREIGN PATENT DOCUMENTS

JP 2001-337028 A 12/2001
JP 2017-187381 A 10/2017
WO 2017/051149 A1 3/2017
WO 2019/145598 A1 8/2019

*Primary Examiner* — Reginald S Tillman, Jr.
(74) *Attorney, Agent, or Firm* — WHDA, LLP

(57) ABSTRACT

A device and a method for managing registration and arrangement of a detonator are proposed. The device includes: a detonator arrangement part configured to arrange, in response to a request for registration of a detonator input by an operator, the detonator on a detonator hole number according to a blasting pattern pre-designed on the basis of arrangement information input by the operator or arranging the detonator on the basis of an arrangement pattern of pre-arranged detonators; an arrangement result analysis part configured to analyze an arrangement result of the detonator that is arranged according to the arrangement pattern of the pre-arranged detonators; and an arrangement error notification part configured to provide notification to the operator when the analyzed arrangement result has an error.

7 Claims, 8 Drawing Sheets

【FIG. 1】
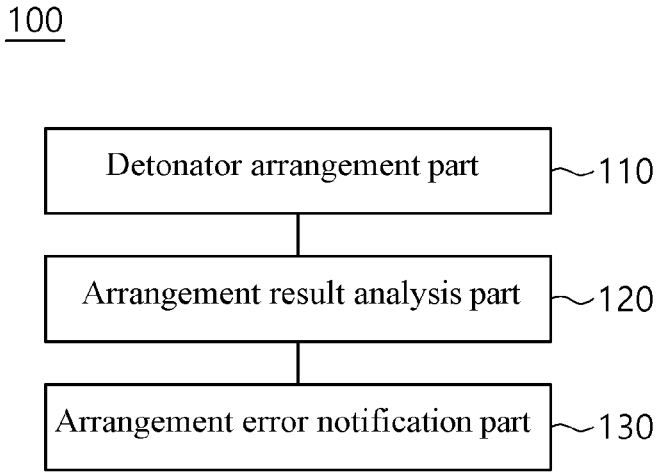

【FIG. 2】
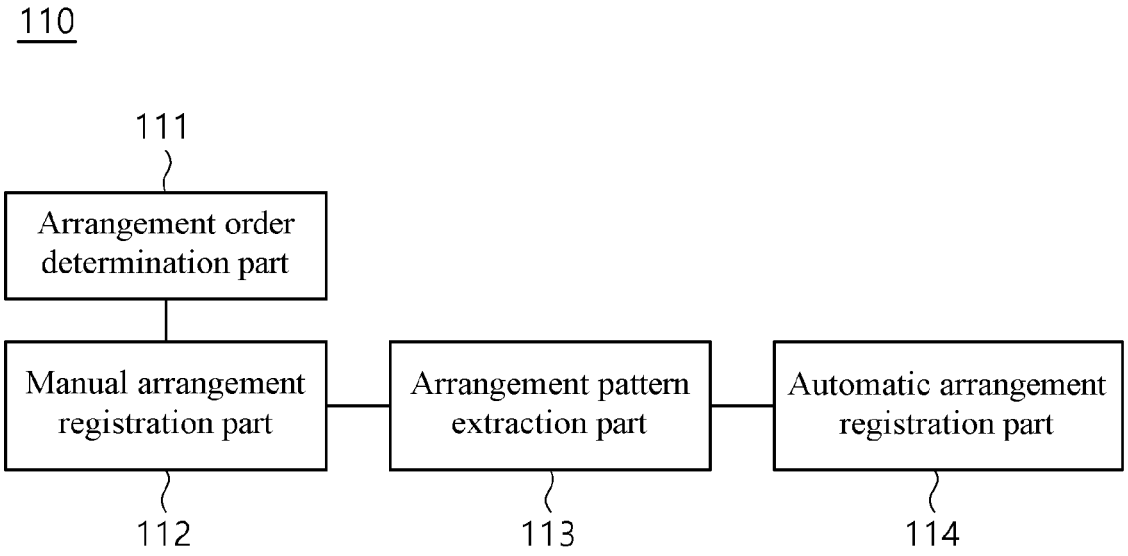

【FIG. 3】
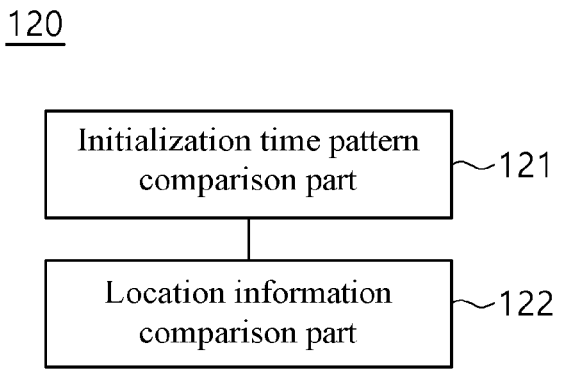

【FIG. 4】
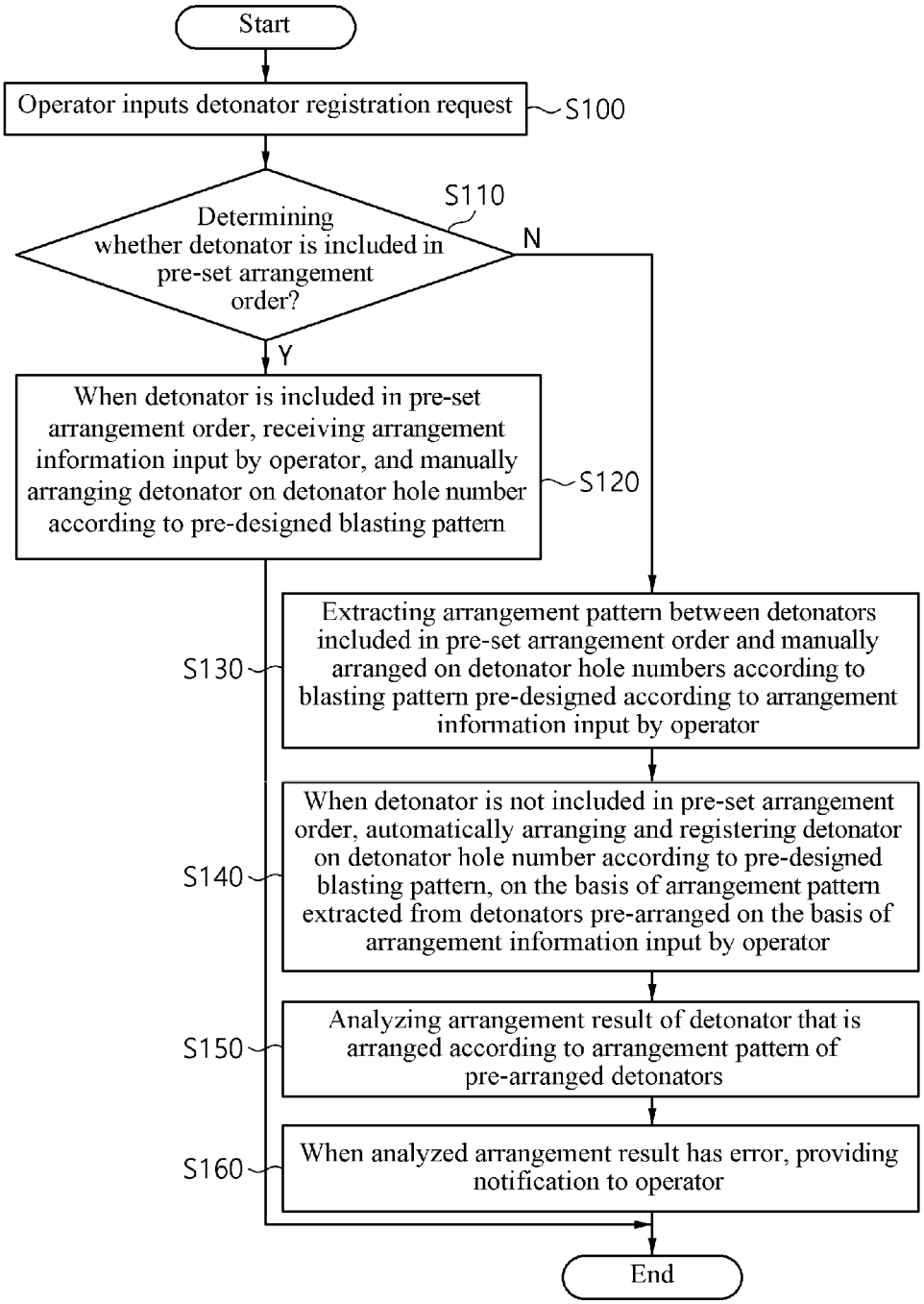

【FIG. 5】

Designed Pattern

| | | | | |
|---|---|---|---|---|
| Hole # : | 1 | 2 | 3 | 4 |
| Delay Time (ms): | 1 | 3 | 5 | 7 |
| Coordinate (m) : | (0, 0) | (0, 10) | (0, 20) | (0, 30) |

• • •

| | | | | |
|---|---|---|---|---|
| Hole # : | 101 | 102 | 103 | 104 |
| Delay Time (ms): | 5 | 7 | 9 | 11 |
| Coordinate (m) : | (1, 0) | (1, 10) | (1, 20) | (1, 30) |

⋮

【FIG. 6】

Registered Detonator Pattern

| | | | | |
|---|---|---|---|---|
| Hole # : | 1 | 2 | 3 | 4 |
| Delay Time (ms): | 1 | 3 | 5 | 7 |
| Coordinate (m) : | (0, 0) | (0, 10) | (0, 20) | (0, 30) |
| GPS (long., lat.) : | (x.xx, x.xxx) | | | |
| Det. ID : | A321 | | | |

| | | | | |
|---|---|---|---|---|
| Hole # : | 101 | 102 | 103 | 104 |
| Delay Time (ms): | 5 | 7 | 9 | 11 |
| Coordinate (m) : | (1, 0) | (1, 10) | (1, 20) | (1, 30) |
| GPS (long., lat.) : | | | | |
| Det. ID : | | | | |

【FIG. 7】

Registered Detonator Pattern

| | | | | |
|---|---|---|---|---|
| | ● | ● | ○ | ○ |
| Hole # : | 1 | 2 | 3 | 4 |
| Delay Time (ms): | 1 | 3 | 5 | 7 |
| Coordinate (m) : | (0, 0) | (0, 10) | (0, 20) | (0, 30) |
| GPS (long., lat.) : | (x.xx, x.xxx) | (x.xx, x.xx) | | |
| Det. ID : | A321 | B412 | | |

| | | | | |
|---|---|---|---|---|
| | ○ | ○ | ○ | ○ |
| Hole # : | 101 | 102 | 103 | 104 |
| Delay Time (ms): | 5 | 7 | 9 | 11 |
| Coordinate (m) : | (1, 0) | (1, 10) | (1, 20) | (1, 30) |
| GPS (long., lat.) : | | | | |
| Det. ID : | | | | |

【FIG. 8】

Registered Detonator Pattern

| | | | | |
|---|---|---|---|---|
| Hole # : | 1 ← ΔHole=1 → | 2 | 3 | 4 |
| Delay Time (ms): | 1 ← ΔD.T.=2 → | 3 | 5 | 7 |
| Coordinate (m) : | (0, 0) | (0, 10) | (0, 20) | (0, 30) |
| GPS (long., lat.) : | (x.xx, x.xxx) | (x.xx, x.xx) | (x.xx, x.xx) | |
| Det. ID : | A321 | B412 | Z322 | |

| | | | | |
|---|---|---|---|---|
| Hole # : | 101 | 102 | 103 | 104 |
| Delay Time (ms): | 5 | 7 | 9 | 11 |
| Coordinate (m) : | (1, 0) | (1, 10) | (1, 20) | (1, 30) |
| GPS (long., lat.) : | | | | |
| Det. ID : | | | | |

DEVICE AND METHOD FOR MANAGING REGISTRATION AND ARRANGEMENT OF DETONATOR

TECHNICAL FIELD

The present disclosure relates to a device and a method for managing registration and arrangement of a detonator. More particularly, the present disclosure relates to a device and a method for managing registration and arrangement of a detonator, wherein the device and the method are configured such that, when an operator inputs a request for registration of a detonator, the detonator is arranged on a detonator hole number according to a blasting pattern pre-designed on the basis of arrangement information input by the operator or is arranged on the basis of an arrangement pattern of pre-arranged detonators.

BACKGROUND ART

The detonation system, which started with the method of attaching a fuse to an industrial detonator developed by Alfred Nobel in 1867, has been developed in a direction consistent with detonation, stability, and precision from an electronic detonator to a non-electric system. In particular, the electronic detonator developed in early 1990s to be used for special purposes with super-precision time difference by an electronic timer is differ from the existing detonation system in the precision per step for the detonation time per step and the method of imparting delay difference.

In the case of an electric detonator and a non-electric detonator that are most generalized and commonly used in blasting sites, the precision thereof has reached the unit of milli-seconds (MS). However, a detonator having a more accurate and precise delay time is increasingly required in today's blasting site. Since the delay time differences of the electric detonator and the non-electric detonator, which are commonly used in Korea, ranges from a minimum of 20~25 ms to a maximum of thousands ms, when the precision thereof is set to ±10%, an error range thereof is in the range of 2 ms to hundreds ms. In domestic tunnel sites, blasting is usually performed by a delayed start detonation method, and it is difficult to determine a blasting pattern appropriate to the site due to the limited step and delayed time difference.

In this relation, a method for designing a tunnel-blasting pattern diagram and a recording medium with a program for providing a tunnel-blasting pattern diagram is disclosed in Korean Patent Application Publication No. 10-2000-0061481.

DISCLOSURE

Technical Problem

Accordingly, the present disclosure has been made keeping in mind the above problems occurring in the related art, and an objective of the present disclosure is to provide a device and a method for managing registration and arrangement of a detonator, wherein the device is configured to extract an arrangement pattern between detonators that are included in arrangement order and manually arranged on detonator hole numbers according to a blasting pattern pre-designed on the basis of arrangement information input by an operator.

Another objective of the present invention is to provide a device and a method for managing registration and arrangement of a detonator, wherein when the detonator is not included in the pre-set arrangement order, on the basis of the arrangement pattern extracted from the detonators pre-arranged according to the arrangement information input by the operator, the detonator is automatically arranged and registered on a detonator hole number according to the pre-designed blasting pattern.

A further objective of the present invention is to provide a device and a method for managing registration and arrangement of a detonator, wherein the device is configured to analyze an arrangement result of the arranged detonator on the basis of an initialization time pattern or location information according to the arrangement pattern of the arranged detonators.

Technical Solution

A device for managing registration and arrangement of a detonator according to the present disclosure to accomplish the above objective includes: a detonator arrangement part configured to arrange, in response to a request for registration of a detonator input by an operator, the detonator on a detonator hole number according to a blasting pattern pre-designed on the basis of arrangement information input by the operator or arranging the detonator on the basis of an arrangement pattern of pre-arranged detonators; an arrangement result analysis part configured to analyze an arrangement result of the detonator that may be arranged according to the arrangement pattern of the pre-arranged detonators; and an arrangement error notification part configured to provide notification to the operator when the analyzed arrangement result has an error.

The blasting pattern may be pre-designed, including at least one of detonator hole numbers, relative or absolute location information for each detonator, delay time, and designed location information on the basis of blasting operation information.

The detonator arrangement part may include: an arrangement order determination part configured to determine whether the detonator is included in a pre-set arrangement order when the operator inputs the detonator registration request; and a manual arrangement registration part configured to receive the arrangement information input by the operator, and to manually arrange and register the detonator on the detonator hole number according to the pre-designed blasting pattern when the detonator is included in the pre-set arrangement order.

The detonator arrangement part may include: an arrangement pattern extraction part configured to extract the arrangement pattern between the detonators that are included in the pre-set arrangement order and manually arranged on detonator hole numbers according to the blasting pattern pre-designed on the basis of the arrangement information input by the operator.

The detonator arrangement part may include: an automatic arrangement registration part configured to automatically arrange and register the detonator on a detonator hole number according to the pre-designed blasting pattern on the basis of the arrangement pattern extracted from the detonators pre-arranged on the basis of the arrangement information input by the operator when the detonator is not included in the pre-set arrangement order.

The detonator arrangement part may be configured to store current location information of the detonator and to assign an ID to the detonator when the detonator is arranged and registered.

The arrangement result analysis part may include: an initialization time pattern comparison part configured to analyze the arrangement result of the arranged detonator by comparing time difference between a delay time interval between the arranged detonators and a delay time interval pre-designed in the blasting pattern to a pre-set time error reference value, and to determine whether the error occurs.

The arrangement result analysis part may include: a location information comparison part configured to analyze the arrangement result of the arranged detonator by comparing distance difference between current location information of the stored detonator stored when the detonator is arranged and registered and location information pre-designed in the blasting pattern to a pre-set distance error reference value, and to determine whether error occurs.

A method for managing registration and arrangement of a detonator includes: by a detonator arrangement part, arranging, in response to a request for registration of a detonator input by an operator, the detonator on a detonator hole number according to a blasting pattern pre-designed on the basis of arrangement information input by the operator, or arranging the detonator on the basis of an arrangement pattern of pre-arranged detonators; by an arrangement result analysis part, analyzing an arrangement result of the detonator that may be arranged according to the arrangement pattern of the pre-arranged detonators; and by an arrangement error notification part, providing notification to the operator when the analyzed arrangement result has an error.

Before the arranging, in response to the request for registration of the detonator input by the operator, the detonator on the detonator hole number according to the blasting pattern pre-designed on the basis of the arrangement information input by the operator or the arranging the detonator on the basis of the arrangement pattern of the pre-arranged detonators, the blasting pattern including at least one of detonator hole numbers, relative or absolute location information for each detonator, delay time, and designed location information on the basis of blasting operation information may be pre-designed.

The arranging, in response to the request for registration of the detonator input by the operator, the detonator on the detonator hole number according to the blasting pattern pre-designed on the basis of the arrangement information input by the operator or arranging the detonator on the basis of the arrangement pattern of the pre-arranged detonators, includes: determining whether the detonator is included in a pre-set arrangement order when the operator inputs the detonator registration request; receiving the arrangement information input by the operator, and manually arranging and registering the detonator on the detonator hole number according to the pre-designed blasting pattern, when the detonator is included in the pre-set arrangement order; and extracting the arrangement pattern between the detonators that may be included in the pre-set arrangement order and manually arranged on detonator hole numbers according to the blasting pattern pre-designed on the basis of the arrangement information input by the operator.

The method may further include: after the determining whether the detonator is included in the pre-set arrangement order when the operator inputs the detonator registration request, automatically arranging and registering the detonator on a detonator hole number according to the pre-designed blasting pattern, on the basis of the arrangement pattern extracted from the detonators pre-arranged on the basis of the arrangement information input by the operator, when the detonator is not included in the pre-set arrangement order.

In the analyzing the arrangement result of the detonator that may be arranged according to the arrangement pattern of the pre-arranged detonators, the arrangement result of the arranged detonator may be analyzed by comparing time difference between a delay time interval between the arranged detonators and a delay time interval pre-designed in the blasting pattern to a pre-set time error reference value, thereby determining whether the error occurs.

In the analyzing the arrangement result of the detonator that may be arranged according to the arrangement pattern of the pre-arranged detonators, the arrangement result of the arranged detonator may be analyzed by comparing distance difference between current location information of the detonator stored when the detonator is arranged and registered and location information pre-designed in the blasting pattern to a pre-set distance error reference value, thereby determining whether the error occurs.

Advantageous Effects

As described above, the device and the method for managing registration and arrangement of a detonator according to the present disclosure is configured to extract the arrangement pattern between the detonators that are included in the pre-set arrangement order and are manually arranged on the detonator hole numbers according to the blasting pattern pre-designed on the basis of the arrangement information input by the operator. When the detonator is not included in the pre-set arrangement order, the detonator is automatically arranged and registered on a detonator hole number according to the pre-designed blasting pattern on the basis of the arrangement pattern extracted from the detonators arranged according to the arrangement information input by the operator. Accordingly, the detonator operation and the real-time arrangement pattern can be modified and debugged, thereby maximizing work efficiency and speed during the blasting designing.

Furthermore, according to the present disclosure, on the basis of the arrangement pattern of the pre-arranged detonators, the arrangement result of the arranged detonator is analyzed according to the initialization time pattern or the location information. Accordingly, errors that may occur due to automatic registration and arrangement of the detonator can be minimized.

DESCRIPTION OF DRAWINGS

FIG. 1 is a view showing configuration of a device for managing registration and arrangement of a detonator according to the present disclosure;

FIG. 2 is a view showing detailed configuration of a detonator arrangement part used in the device for managing registration and arrangement of a detonator according to the present disclosure;

FIG. 3 is a view showing detailed configuration an arrangement result analysis part used in the device for managing registration and arrangement of a detonator according to the present disclosure;

FIG. 4 is a flowchart showing an order of a method for managing registration and arrangement of a detonator according to the present disclosure; and FIGS. 5 to 8 are example views for convenience in understanding of the method for managing registration and arrangement of a detonator according to the present disclosure.

DESCRIPTION OF REFERENCE NUMERALS

100: device for managing registration and arrangement of a detonator

110: detonator arrangement part
120: arrangement result analysis part
130: arrangement error notification part

BEST MODE

Reference will now be made in detail to various embodiments of the present invention, specific examples of which are illustrated in the accompanying drawings and described below, since the embodiments of the present invention can be variously modified in many different forms.

While the present invention will be described in conjunction with exemplary embodiments thereof, it is to be understood that the present description is not intended to limit the present invention to those exemplary embodiments. On the contrary, the present invention is intended to cover not only the exemplary embodiments, but also various alternatives, modifications, equivalents and other embodiments that may be included within the spirit and scope of the present invention as defined by the appended claims. In the figures, the same reference numerals will be used throughout the drawings to refer to the same or like elements or parts.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Hereinbelow, the exemplary embodiments of the present invention will be described in detail with reference to the accompanying drawings. Throughout the drawings, the same reference numerals will refer to the same or like parts and redundant descriptions of the same elements will be omitted.

FIG. 1 is a view showing configuration of a device for managing registration and arrangement of a detonator according to the present disclosure.

Referring to FIG. 1, according to the present disclosure, the device for managing registration and arrangement of a detonator 100 includes a detonator arrangement part 110, an arrangement result analysis part 120, and an arrangement error notification part 130. A blasting pattern is pre-designed, including at least any one of a detonator hole number, a relative or absolute location information for each detonator, a delay time, and a designed location information on the basis of blasting operation information stored in blasting management software.

When an operator inputs a request for registration of a detonator (the detonator registration request), the detonator arrangement part 110 arranges the detonator on a detonator hole number according to the blasting pattern pre-designed on the basis of arrangement information input by the operator, or arranges the detonator according to an arrangement pattern of pre-arranged detonators.

When the detonator is included in a pre-set arrangement order, the detonator arrangement part 110 receives the arrangement information input by the operator, and manually arranges the detonator on the detonator hole number according to the pre-designed blasting pattern.

When the detonator is not included in the pre-set arrangement order, the detonator arrangement part 110 automatically arranges the detonator on the detonator hole number according to the pre-designed blasting pattern, on the basis of the arrangement pattern extracted from the detonators pre-arranged according to the arrangement information input by the operator. The pre-set arrangement order is an order recognizing a point of change from manual setting to automatic setting when the detonator is arranged in the pre-designed blasting pattern. Being included in the pre-designed arrangement order means that the detonator is arranged in the pre-designed blasting pattern by the manual setting, and being not included in the pre-designed arrangement order means that the detonator is arranged in the pre-designed blasting pattern by the automatic setting. Furthermore, the arrangement order is not limited thereto and may be pre-set freely.

When the preset arrangement order is from a third detonator, when the operator tries to register a first detonator, in the detonator arrangement part 110, the first detonator is manually arranged in a detonator hole number at any position of the pre-designed blasting pattern. In addition, when the operator tries to register a second detonator, the second detonator is manually arranged in a detonator hole number at any position of the pre-designed blasting pattern. In addition, when the operator tries to register a third detonator, the detonator is arranged at a detonator hole number automatically set according to the arrangement pattern extracted from the first and second detonators that are arranged earlier.

When the detonator is arranged and registered, the detonator arrangement part 110 stores current location information of the detonator and assigns an ID to the detonator.

The arrangement result analysis part 120 analyzes an arrangement result of the detonator arranged according to the arrangement pattern of the pre-arranged detonators.

The arrangement result analysis part 120 analyzes the arrangement result of the detonator by comparing time difference between a delay time interval between the arranged detonators and a delay time interval pre-designed in the blasting pattern to a pre-set time error reference value, and by comparing distance difference between current location information of the detonator, which is stored when the detonator is arranged and registered, and location information pre-designed in the blasting pattern to a pre-set distance error reference value.

When the analyzed arrangement result has an error, the arrangement error notification part 130 provides a notification to the operator.

When there is an error in either a result of comparing the time difference between the delay time interval between the arranged detonators and the delay time interval pre-designed in the blasting pattern to the pre-set time error reference value or a result of comparing the distance difference between the current location information of the stored detonator and the location information pre-designed in the blasting pattern to the pre-set distance error reference value, the arrangement error notification part 130 provides the notification to the operator.

As described above, when the error notification is provided to the operator, the operator can manually arrange the detonator on the appropriate detonator hole number.

FIG. 2 is a view showing detailed configuration of the detonator arrangement part used in the device for managing registration and arrangement of a detonator according to the present disclosure.

Referring to FIG. 2, according to the present disclosure, when the operator inputs the detonator registration request, the detonator arrangement part 110 arranges the detonator on the detonator hole number according to the blasting pattern pre-designed on the basis of the arrangement information input by the operator, or arranges the detonator according to the arrangement pattern of the pre-arranged detonators.

In order to achieve the above operation, the detonator arrangement part 110 includes an arrangement order determination part 111, a manual arrangement registration part 112, an arrangement pattern extraction part 113, and an automatic arrangement registration part 114.

When the operator inputs the detonator registration request, the arrangement order determination part 111 determines whether the detonator is included in the pre-set arrangement order.

When the detonator is included in the pre-set arrangement order, the manual arrangement registration part 112 receives the arrangement information input by the operator, and manually arranges and registers the detonator on the detonator hole number according to the pre-designed blasting pattern.

The arrangement pattern extraction part 113 extracts the arrangement the arrangement pattern between the detonators that are included in the pre-set arrangement order and manually arranged on the detonator hole numbers according to the blasting pattern pre-designed on the basis of the arrangement information input by the operator.

The arrangement pattern extraction part 113 may extract the arrangement pattern with the following equation.

$$\begin{aligned} Hole_i &= Hole_{i-1} + \Delta Hole \\ &= Hole_{i-1} + (Hole_{i-1} - Hole_{i-2}) \\ &= 2 * Hole_{i-1} - Hole_{i-2} \end{aligned} \quad \text{[Equation 1]}$$

When the detonator is not included in the pre-set arrangement order, the automatic arrangement registration part 114 automatically arranges the detonator on the detonator hole number according to the pre-designed blasting pattern, on the basis of the arrangement pattern extracted from the detonators pre-arranged according to the arrangement information input by the operator.

FIG. 3 is a view showing detailed configuration the arrangement result analysis part used in the device for managing registration and arrangement of a detonator according to the present disclosure.

Referring to FIG. 3, according to the present disclosure, the arrangement result analysis part 120 analyzes the arrangement result of the detonator according to the arrangement pattern of the pre-arranged detonators.

In order to achieve the above operation, the arrangement result analysis part 120 includes an initialization time pattern comparison part 121 and a location information comparison part 122.

The initialization time pattern comparison part 121 compares the time difference between the delay time interval between the arranged detonators and the delay time interval pre-designed in the blasting pattern to the pre-set time error reference value to analyze the arrangement result of the arranged detonator, thereby determining whether the error occurs. Equation used therein is as follows.

$$\begin{aligned} D.T._i &= D.T._{i-1} + \Delta D.T. \\ &= D.T._{i-1} + (D.T._{i-1} - D.T._{i-2}) \\ &= 2 * D.T._{i-1} - D.T._{i-2} \end{aligned} \quad \text{[Equation 2]}$$

$$D.T._i = D.T._{i_designed} < \text{Max.error}$$

When the time difference between the delay time interval between the arranged detonators and the delay time interval pre-designed in the blasting pattern exceeds the pre-set time error reference value, the initialization time pattern comparison part 121 determines that the error occurs.

The location information comparison part 122 compares the distance difference between the current location information of the detonator, which is stored when the detonator is arranged and registered, and the location information pre-designed in the blasting pattern to the pre-set distance error reference value to analyze the arrangement result of the arranged detonator, thereby determining whether the error occurs. Equation used therein is as follows.

$$\Delta\text{GPS} - \Delta\text{Coordinate}_{designed} < \text{Max.error} \quad \text{[Equation 3]}$$

When the distance difference between the current location information of the detonator stored when the detonator is arranged and registered and the location information pre-designed in the blasting pattern exceeds the pre-set distance error reference value, the location information comparison part 122 determines that the error occurs.

FIG. 4 is a flowchart showing an order of a method for managing registration and arrangement of a detonator according to the present disclosure. FIGS. 5 to 8 are example views for convenience in understanding of the method for managing registration and arrangement of a detonator according to the present disclosure.

Referring to FIG. 4, the method for managing registration and arrangement of a detonator according to the present disclosure uses the device for managing registration and arrangement of a detonator described above, and redundant descriptions will be omitted below.

First, the operator inputs the detonator registration request (S100).

Next, the arrangement order determination part of the detonator arrangement part determines whether the detonator is included in the pre-set arrangement order (S110).

When the detonator is included in the pre-set arrangement order in S110, the detonator arrangement part receives the arrangement information input by the operator, and manually arranges and registers the detonator on the detonator hole number according to the blasting pattern (S120). The blasting pattern is pre-designed, including at least one of the detonator hole number, a relative or absolute location information for each detonator, a delay time, and a designed location information on the basis of the blasting operation information stored in the blasting management software, as shown in FIG. 5.

In S120, when the operator tries to register a first detonator, the first detonator may be manually arranged on a detonator hole number at a specific location in the pre-designed blasting pattern, as shown in FIG. 6. When the operator tries to register a second detonator, the second detonator may be manually arranged on a detonator hole number at a specific location in the pre-designed blasting pattern, as shown in FIG. 7.

Then, the arrangement pattern is extracted from the detonators that are included in the pre-set arrangement order and manually arranged on the detonator hole numbers according to the blasting pattern pre-designed on the basis of the arrangement information input by the operator (S130).

In S110, when the detonator is not included in the pre-set arrangement order, on the basis of the arrangement pattern extracted from the detonators pre-arranged on the basis of the arrangement information input by the operator in S130, the detonator is automatically arranged and registered on the detonator hole number according to the blasting pattern (S140).

In S140, when the operator tries to register a third detonator, a detonator hole number may be automatically set on the basis of the arrangement pattern extracted from the first and second detonators that are arranged earlier, as shown in FIG. 8.

Next, an arrangement result of the detonator that is arranged according to the arrangement pattern of the pre-arranged detonators is analyzed (S150).

In S150, the arrangement result of the detonator is analyzed by comparing the time difference between the delay time interval between the arranged detonators and the delay time interval pre-designed in the blasting pattern to the pre-set time error reference value, and by comparing the distance difference between current location information of the detonator, which is stored when the detonator is arranged and registered, and the location information pre-designed in the blasting pattern to the pre-set distance error reference value.

Next, when the analyzed arrangement result has an error, the notification is provided to the operator (S160).

In S160, when it is analyzed that an error occurs in either one of the results of comparing the time difference between the delay time interval between the arranged detonators and the delay time interval pre-designed in the blasting pattern to the pre-set time error reference value, or of comparing the distance difference between current location information of the detonator stored when the detonator is arranged and registered and the location information pre-designed in the blasting pattern to the pre-set distance error reference value, the notification is provided to the operator.

The functional operations and embodiments described herein above, including the structure disclosed in the specification and structural equivalents thereof, may be implemented in a digital electronic circuit, computer software, firmware, or hardware, or in a combination of one or more thereof.

The embodiments of the subject matter described herein may be implanted as one or more modules relating to computer program commands encoded on a tangible program medium for execution by one or more computer program products, i.e., by the data processing device or for controlling the operation of the data processing device. The tangible program medium may be a radio wave signal or a computer-readable medium. The radio wave signal is an electrical, optical, or artificial signal, e.g., machine generated, generated to encode information for transmitting to a suitable receiver device for execution by a computer. The computer-readable medium may be a machine-readable storage device, a machine-readable storage substrate, a memory device, a combination of materials that affect a machine-readable propagated signal, or a combination of one or more thereof.

Computer programs (also known as program, software, software application, script or a code) may be written in any form of programming language, including compiled or interpreted language or priori or procedural language. The Computer programs may be deployed in form, including standalone programs or modules, components, subroutines, or other units suitable for use in a computer environment.

The computer program does not necessarily correspond to the file of the file device. The computer program may be stored in a single file provided to the requested program, or within multiple interactive files (e.g., a file that stores one or more modules, subprograms, or portions of code, or a portion of a file that holds other programs or data (e.g., one or more scripts stored in markup language document).

The computer program may be located at one side or distributed across a plurality of sites, and may be deployed to be executed on a single computer or multiple computers interconnected by a communication network.

Additionally, the logical flow and structural block diagram described in the present patent document describes an act and/or a specific method supported by functions and steps supported by the disclosed structural means. It can also be used to set algorithms and their equivalents.

In order to perform a function by operating on received data and generating an output, the processes and logic flows described herein may be executed by one or more programmable processors executing one or more the computer programs.

The processors suitable for execution of the computer program includes, for example, both general purpose and special purpose microprocessors and any one or more processors of any type of digital computer being a processor. In general, the processor receives instructions and data from read-only memory, random access memory, or both of them.

A key element of a computer is one or more memory devices for storing instructions and data, and a processor for performing the instructions. Computers may be combined to receive data from, transfer data to, or perform both of the operations from one or more mass storage devices for storing data, such as magnetic, magneto-optical disk, or optical disk, or may include the devices. However, the computers do not need to have the devices.

The described provides the best mode of the present disclosure to explain the present disclosure, and provides an example for making and using the present disclosure to those skilled in the art. The specification does not limit the present disclosure by the specific terms presented.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. In order to achieve the intended effect of the present disclosure, it is not necessary to separately include all functional blocks shown in the drawings, or to follow all the sequences shown in the drawings in the order as shown in the drawings. Please not that it may fall within the technical scope of the present disclosure as stated in the claims.

The invention claimed is:

1. A device for managing registration and arrangement of a detonator, the device comprising:

a processor configured to arrange, in response to a request for registration of a detonator input by an operator, the detonator on a detonator hole number according to a blasting pattern pre-designed on the basis of arrangement information input by the operator or arranging the detonator on the basis of an arrangement pattern of pre-arranged detonators;

the processor configured to analyze an arrangement result of the detonator that is arranged according to the arrangement pattern of the pre-arranged detonators; and the processor configured to provide notification to the operator when the analyzed arrangement result has an error, wherein the blasting pattern is pre-designed, including at least one of detonator hole numbers, relative or absolute location information for each detonator, delay time, and designed location information on the basis of blasting operation information, wherein the processor comprises:

the processor configured to determine whether the detonator is included in a pre-set arrangement order when the operator inputs the detonator registration request;

the processor configured to receive the arrangement information input by the operator, and to manually arrange and register the detonator on the detonator hole number according to the pre-designed blasting pattern when the detonator is included in the pre-set arrangement order;

the processor configured to extract the arrangement pattern between the detonators that are included in the pre-set arrangement order and manually arranged on detonator hole numbers according to the blasting pattern pre-designed on the basis of the arrangement information input by the operator; and the processor configured to automatically arrange and register the detonator on the detonator hole number according to the pre-designed blasting pattern on the basis of the arrangement pattern extracted from the detonators pre-arranged on the basis of the arrangement information input by the operator when the detonator is not included in the pre-set arrangement order, and wherein the pre-set arrangement order is an order recognizing a point of change from manual setting to automatic setting when the detonator is arranged in the pre-designed blasting pattern, wherein when the detonator is included in the pre-designed arrangement order, the detonator is arranged in the pre-designed blasting pattern by the manual setting, and when the detonator is not included in the pre-designed arrangement order, the detonator is arranged in the pre-designed blasting pattern by the automatic setting.

2. The device of claim 1, wherein the processor is configured to store current location information of the detonator and to assign an ID to the detonator when the detonator is arranged and registered.

3. The device of claim 1, wherein the processor comprises:

the processor configured to analyze the arrangement result of the arranged detonator by comparing time difference between a delay time interval between the arranged detonators and a delay time interval pre-designed in the blasting pattern to a pre-set time error reference value, and to determine whether the error occurs.

4. The device of claim 1, wherein the processor comprises:

the processor configured to analyze the arrangement result of the arranged detonator by comparing distance difference between current location information of the stored detonator stored when the detonator is arranged and registered and location information pre-designed in the blasting pattern to a pre-set distance error reference value, and to determine whether error occurs.

5. A method for managing registration and arrangement of a detonator, the method comprising:

by a processor, arranging, in response to a request for registration of a detonator input by an operator, the detonator on a detonator hole number according to a blasting pattern pre-designed on the basis of arrangement information input by the operator, or arranging the detonator on the basis of an arrangement pattern of pre-arranged detonators;

by the processor, analyzing an arrangement result of the detonator that is arranged according to the arrangement pattern of the pre-arranged detonators; and by the processor, providing notification to the operator when the analyzed arrangement result has an error wherein, before the arranging, in response to the request for registration of the detonator input by the operator, the detonator on the detonator hole number according to the blasting pattern pre-designed on the basis of the arrangement information input by the operator or the arranging the detonator on the basis of the arrangement pattern of the pre-arranged detonators, the blasting pattern including at least one of detonator hole numbers, relative or absolute location information for each detonator, delay time, and designed location information on the basis of blasting operation information is pre-designed, wherein the arranging, in response to the request for registration of the detonator input by the operator, the detonator on the detonator hole number according to the blasting pattern pre-designed on the basis of the arrangement information input by the operator or arranging the detonator on the basis of the arrangement pattern of the pre-arranged detonators, comprises:

determining whether the detonator is included in a pre-set arrangement order when the operator inputs the detonator registration request receiving the arrangement information input by the operator, and manually arranging and registering the detonator on the detonator hole number according to the pre-designed blasting pattern, when the detonator is included in the pre-set arrangement order;

extracting the arrangement pattern between the detonators that are included in the pre-set arrangement order and manually arranged on detonator hole numbers according to the blasting pattern pre-designed on the basis of the arrangement information input by the operator; and after the determining whether the detonator is included in the pre-set arrangement order when the operator inputs the detonator registration request, automatically arranging and registering the detonator on the detonator hole number according to the pre-designed blasting pattern, on the basis of the arrangement pattern extracted from the detonators pre-arranged on the basis of the arrangement information input by the operator, when the detonator is not included in the pre-set arrangement order, and wherein the pre-set arrangement order is an order recognizing a point of change from manual setting to automatic setting when the detonator is arranged in the pre-designed blasting pattern, wherein when the detonator is included in the pre-designed arrangement order, the detonator is arranged in the pre-designed blasting pattern by the manual setting, and when the detonator is not included in the pre-designed arrangement order, the detonator is arranged in the pre-designed blasting pattern by the automatic setting.

6. The method of claim 5, wherein, in the analyzing the arrangement result of the detonator that is arranged according to the arrangement pattern of the pre-arranged detonators, the arrangement result of the arranged detonator is analyzed by comparing time difference between a delay time interval between the arranged detonators and a delay time interval pre-designed in the blasting pattern to a pre-set time error reference value, thereby determining whether the error occurs.

7. The method of claim 5, wherein, in the analyzing the arrangement result of the detonator that is arranged according to the arrangement pattern of the pre-arranged detonators, the arrangement result of the arranged detonator is analyzed by comparing distance difference between current location information of the detonator stored when the detonator is arranged and registered and location information pre-designed in the blasting pattern to a pre-set distance error reference value, thereby determining whether the error occurs.

* * * * *